US010953258B2

(12) United States Patent
Goodwin

(10) Patent No.: US 10,953,258 B2
(45) Date of Patent: Mar. 23, 2021

(54) FLEXURE TUBE EXERCISE DEVICE

(71) Applicant: Paul Kelley Goodwin, Newhall, CA (US)

(72) Inventor: Paul Kelley Goodwin, Newhall, CA (US)

( * ) Notice: Subject to any disclaimer, the term of this patent is extended or adjusted under 35 U.S.C. 154(b) by 0 days.

(21) Appl. No.: 16/382,166

(22) Filed: Apr. 11, 2019

(65) Prior Publication Data

US 2019/0314665 A1 Oct. 17, 2019

Related U.S. Application Data

(60) Provisional application No. 62/656,323, filed on Apr. 11, 2018.

(51) Int. Cl.

| | |
|---|---|
| ***A63B 21/02*** | (2006.01) |
| ***A63B 21/04*** | (2006.01) |
| ***A63B 21/16*** | (2006.01) |
| ***A63B 23/035*** | (2006.01) |

(52) U.S. Cl.

CPC ..... *A63B 21/026* (2013.01); *A63B 21/0442* (2013.01); *A63B 21/1672* (2015.10); *A63B 23/03541* (2013.01); *A63B 2208/0214* (2013.01)

(58) Field of Classification Search

CPC ..... A63B 21/00069; A63B 21/00072; A63B 21/00189; A63B 21/008; A63B 21/0083; A63B 21/0085; A63B 21/0087; A63B 21/0088; A63B 21/02; A63B 21/023; A63B 21/04; A63B 21/0442; A63B 21/045; A63B 21/05; A63B 21/158; A63B 21/159; A63B 21/1672; A63B 21/1681; A63B 21/1618; A63B 21/1627; A63B 21/1636; A63B 21/1645; A63B 21/1654; A63B 21/1663; A63B 21/4023; A63B 21/4045; A63B 23/0205; A63B 23/0211; A63B 23/03508; A63B 23/03516; A63B 23/03533; A63B 23/1254; A63B 23/1263; A63B 23/1272; A63B 2208/0214; A63B 2208/0223; A63B 2208/0228; A63B 2210/50; A63B 2210/54; A63B 2210/58

See application file for complete search history.

(56) References Cited

U.S. PATENT DOCUMENTS

| | | | |
|---|---|---|---|
| 4,406,453 | A | 9/1983 | Herzfeld |
| 4,466,610 | A | 8/1984 | Israel |

(Continued)

*Primary Examiner* — Garrett K Atkinson
*Assistant Examiner* — Zachary T Moore
(74) *Attorney, Agent, or Firm* — Charles Runyan; Runyan Law

(57) ABSTRACT

An exercise device includes a first anchor tube, a first flex tube, a first resistance coupler, and a first stiffener. The first anchor tube is configured to be anchored between two substantially fixed surfaces. The first flex tube is configured to provide resistance against and in response to manual flexing of the first flex tube. The first resistance coupler comprises a resilient material and is configured to attach the first flex tube to the first anchor tube. The first resistance coupler is made from a resilient material that provides resistance against and in response to manual manipulation of the first anchor tube and the first flex tube relative to each other. The first stiffener rod is sized to be inserted within the first flex tube to increase resistance required for manual manipulation.

10 Claims, 4 Drawing Sheets

(56) References Cited

U.S. PATENT DOCUMENTS

| | | | | |
|---|---|---|---|---|
| 4,489,937 | A * | 12/1984 | Kong | A63B 21/00043 482/126 |
| 4,580,778 | A | 4/1986 | Van Noord | |
| 5,755,649 | A * | 5/1998 | Bimby | A63B 23/03533 482/121 |
| 6,508,749 | B1 | 1/2003 | Broadwater | |
| 7,569,003 | B1 * | 8/2009 | Huffman | A63B 23/0355 482/112 |
| 7,878,956 | B2 * | 2/2011 | Kadar | A63B 23/12 482/129 |
| 9,492,706 | B1 | 11/2016 | Turnbow | |
| 10,137,346 | B1 * | 11/2018 | Williams | A63B 69/002 |
| 2005/0113221 | A1 | 5/2005 | Dovner | |
| 2007/0072752 | A1 * | 3/2007 | Koch | A63B 21/026 482/121 |
| 2007/0093366 | A1 * | 4/2007 | Zuckerman | A63B 21/026 482/121 |
| 2012/0322632 | A1 * | 12/2012 | Kezer | A63B 21/026 482/121 |
| 2013/0178344 | A1 * | 7/2013 | Walsh | A63B 21/0442 482/122 |
| 2013/0267394 | A1 * | 10/2013 | Duke | A63B 21/4043 482/110 |
| 2019/0160323 | A1 * | 5/2019 | Anaya | A63B 21/4035 |

* cited by examiner

FLEXURE TUBE EXERCISE DEVICE

CROSS REFERENCE TO RELATED APPLICATION

The present application is related to and claims priority to U.S. Provisional Patent Application No. 62/656,323 filed Apr. 11, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of exercise equipment and more specifically relates to personal exercise equipment.

2. Description of Related Art

U.S. Pat. No. 6,508,749 to Ronald L. Broadwater relates to a portable exercise device. The described portable exercise device includes an elastic cord with two ends. Each of the ends of the cord is received into opposite sides of a coupling. A clamp element is provided around a portion of the coupling. The clamp element compresses the coupling around the elastic cord to hold the cord in place inside the coupling. A handle may be provided around the coupling. The handle may be made from a resilient material so that the hand of the user may squeeze it. Additionally, end plugs may be provided for the handle to prevent the handle from slipping off the coupling.

BRIEF SUMMARY OF THE INVENTION

In view of the foregoing disadvantages inherent in the known exercise equipment art, the present disclosure provides a novel flexure tube exercise device. The general purpose of the present disclosure, which will be described subsequently in greater detail, is to provide an exercise device having a first anchor tube, a first flex tube, a first resistance coupler, and a first stiffener. The first anchor tube is configured to be anchored between two substantially fixed surfaces. The first flex tube is configured to provide resistance against and in response to manual flexing of the first flex tube. The first resistance coupler is constructed of a resilient material and is configured to attach the first flex tube to the first anchor tube. The first resistance coupler is made from a resilient material that provides resistance against and in response to manual manipulation of the first anchor tube and the first flex tube relative to each other. The first stiffener rod is sized to be inserted within the first flex tube to increase resistance required for manual manipulation.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a flexure tube exercise device, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to exercise and more particularly to an exercise device as used to improve the efficiency and effectiveness of personal exercise equipment.

Generally, the present exercise device provides an apparatus enabling individuals to exercise nearly anywhere in a variety of different ways. The invention is a portable device that includes a plurality of tubes that may be used for resistance exercises. In a preferred embodiment, a device is used in each hand. A dynamic range of exercises may be performed using the equipment. In one method of operation, an end of the exercise device is retained in a static position, while the other end is gripped by the user. The static end may be affixed in any convenient manner; for example, by being placed under a mattress of a bed. A required bending force of variable magnitude is provided by the material composition and structure of the device which allows a resistance exercise to be performed. In another method of operation, the device may be griped at each end for through manual manipulation of the resilient material, such that the user is working against his or her own force rather than a static object. In yet another embodiment, the device may be tethered to a static location or another device, allowing for many other exercises to be performed.

The disclosed exercise device comprises several linear tubes made from a resilient material that bends under force and returns to a starting shape when the force is released. The force required to bend the tubes may be supplemented with a stiffener rod inserted into the tubes to further increase resistance. The tubes include a coupling mechanism that allows the tubes to be disassembled for easy storage. The coupling mechanism may also provide a resistance to bending of the tubes. The tubes include end pieces that enable the attachment of handles and other auxiliary devices used for exercise. The overall function of the disclosed invention is to provide a modular exercise device that may be disassembled and reconfigured for easy transport. is collapsible into a small form factor for portability, allowing a user to discreetly carry the device when traveling.

Referring now more specifically to the drawings by numerals of reference, there is shown in FIGS. 1-4, various views of an exercise device 100.

Figure 1:
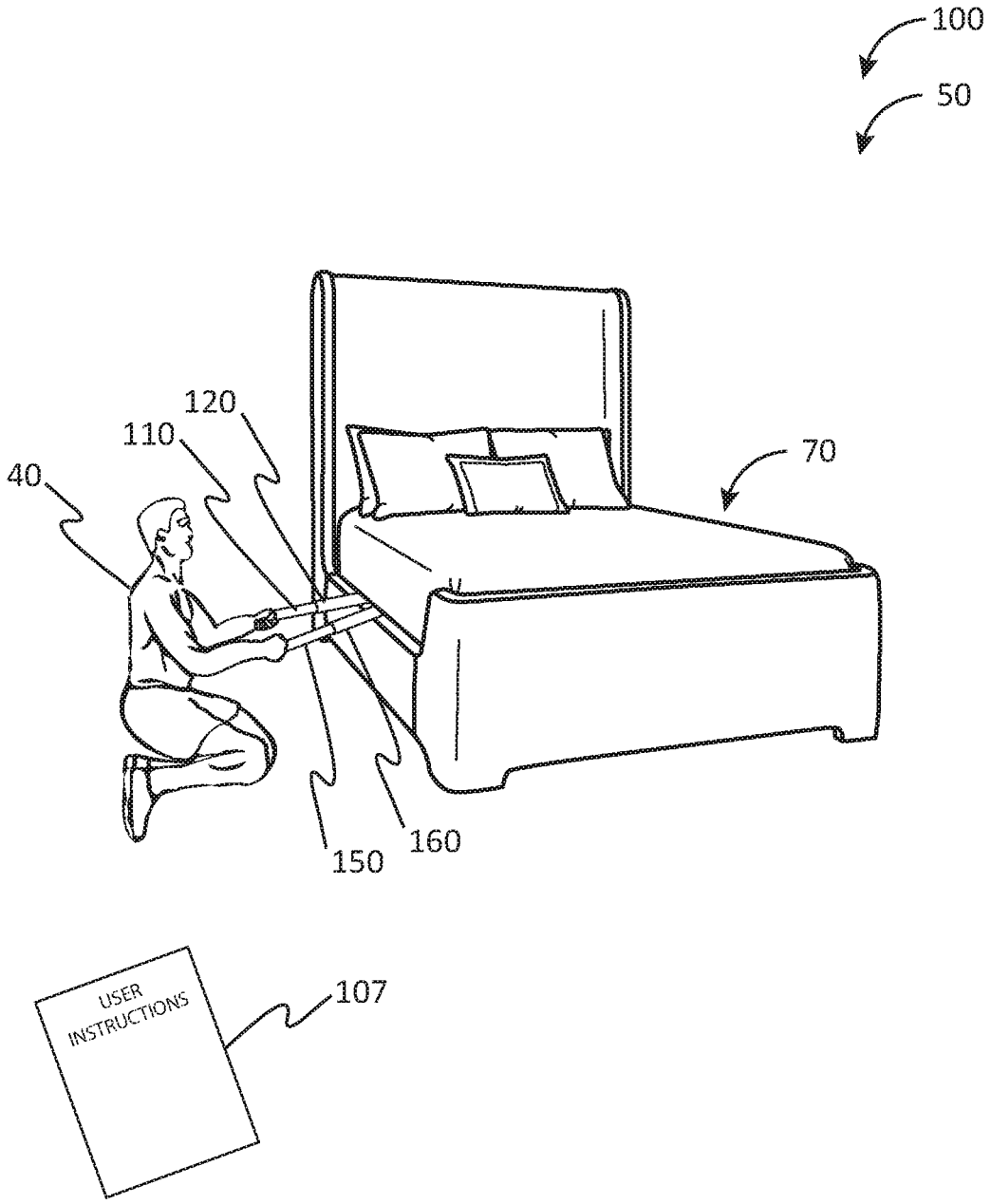
FIG. 1 is another view of the exercise device during an 'in-use' condition, according to an embodiment of the disclosure.

Referring now more specifically to the drawings by numerals of reference, there is shown in FIGS. 1-4, various views of an exercise device 100. FIG. 1 shows an exercise device 100 during an 'in-use' condition 50 by a user 40, according to an embodiment of the present disclosure. As illustrated, the exercise device 100 may include a first anchor tube 120 that is configured to be anchored between two substantially fixed surfaces 70. The first anchor tube 110 is defined by two opposing first anchor ends separated by a first anchor length. The first flex tube 110 is configured to provide resistance against and in response to manual flexing of the first anchor tube 120. A first resistance coupler 130 is made of a resilient material and includes a first anchor couple and a first anchor tube couple. The first anchor couple is configured to couple with at least one of the two opposing first anchor-ends. The first anchor tube couple is configured to couple with at least one of the two opposing first anchor tube ends. The resilient material is configured to provide resistance against and in response to manual manipulation of at least one of the first anchor tube 110 and the first anchor tube relative to each other.

As shown, a second matching exercise device 100 may be included in an optimal embodiment. In this optimal embodiment of the exercise device 100, a second anchor tube 150 is configured to be anchored between two substantially fixed surfaces 70. The second anchor tube 150 is defined by two opposing second anchor ends separated by a second anchor length. A second flex tube 160 is defined by two opposing second flex tube ends separated by a second flex tube length. The second flex tube 160 is configured to provide resistance against and in response to manual flexing of said second flex tube 160. A second resistance coupler 170 is made of a resilient material and includes a second anchor couple and a second flex tube couple. The second anchor couple is configured to couple with at least one of the two opposing second anchor-ends. The second flex tube couple is configured to couple with at least one of the two opposing second flex tube ends. The resilient material is configured to provide resistance against and in response to manual manipulation of at least one of the second anchor tube 150 and the second flex tube 160 relative to each other.

According to one embodiment, the exercise device 100 may be arranged as a kit. The kit 107 may include instructions. The instructions may detail functional relationships in relation to the structure of the exercise device 100 (such that the exercise device 100 can be used, maintained, or the like, in a preferred manner). The instructions may further guide a user on configurations and uses of the exercise device to perform various exercises.

Figure 2:
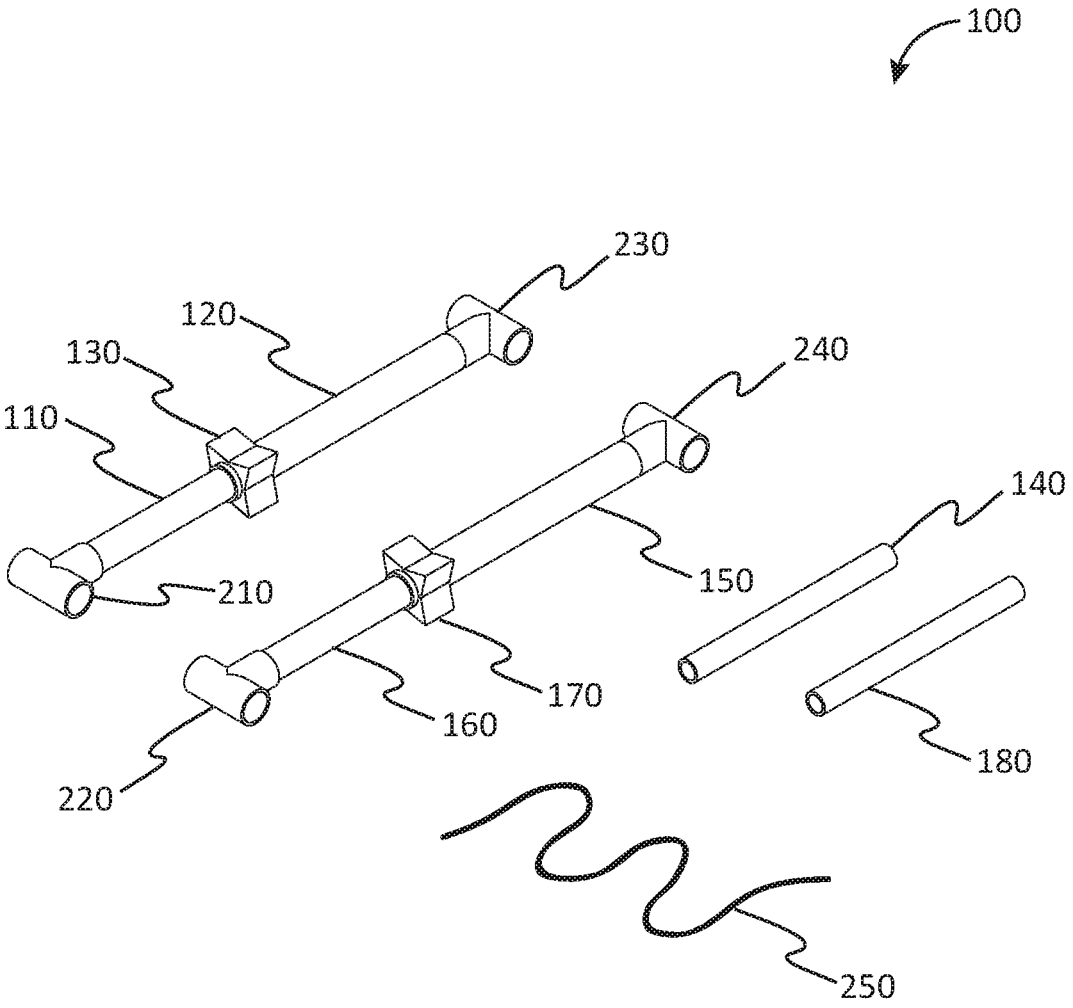
FIG. 2 is a perspective view of the exercise device of FIG. 1, according to an embodiment of the present disclosure.

FIG. 2 shows a perspective view of the exercise device 100 of FIG. 1, according to an embodiment of the present disclosure. As above, the exercise device 100 may include a first flex tube 110, a first anchor tube 120, a first resistance coupler 130, and a first stiffener rod 140. The first flex tube 110 and the first anchor tube 120 are configured to be attached via the first resistance coupler 130. The first anchor tube 110 may be anchored between two substantially fixed surfaces 70. While in connection with the first flex tube 110, the first anchor tube 120 is manually manipulated to achieve resistance exercise. A first stiffener rod 140 may be inserted within the first flex tube 110, thereby increasing the force required to effectively bend the first flex tube 110. In a preferred embodiment, a second anchor tube 150 is connected to a second flex tube 160 with a second resistance coupler 170. A second stiffener rod 180 may be used to supplement bending force required during exercise.

Additional attachments may be included with the exercise device 100 that allow for a broader range of exercises to be performed. A first anchor tube attachment 230 may be configured to couple with one of the opposing first anchor tube ends. The first anchor tube attachment 230 may embody various sizes, shapes, and functionalities that enable the user to optimize exercise movements and ergonomic preferences. Additionally, second anchor tube attachment 240 may be configured to couple with one of the opposing second anchor tube ends. The second flex tube attachment 220 may serve the same purpose as the first anchor tube attachment 230 by enhancing the functionality and comfort of the exercise device 100. Similarly, a first flex tube attachment 210, and a second flex tube attachment 220 may be configured to couple with one of the respective flex tube ends. A tether 250 may be included with the exercise device 100. According to preference and exercises performed, the tether 250 may comprise a resilient material having various elastic properties. The tether 250 may be configured to connect the first anchor tube attachment 230 to the second flex tube attachment 220. The tether 250 may further be used to connect the first flex tube attachment 210 with the second flex tube attachment 220. Any combination or conceived usage of the aforementioned attachments with the tether 250 may be considered as functional usage of the exercise device 100.

Figure 3:
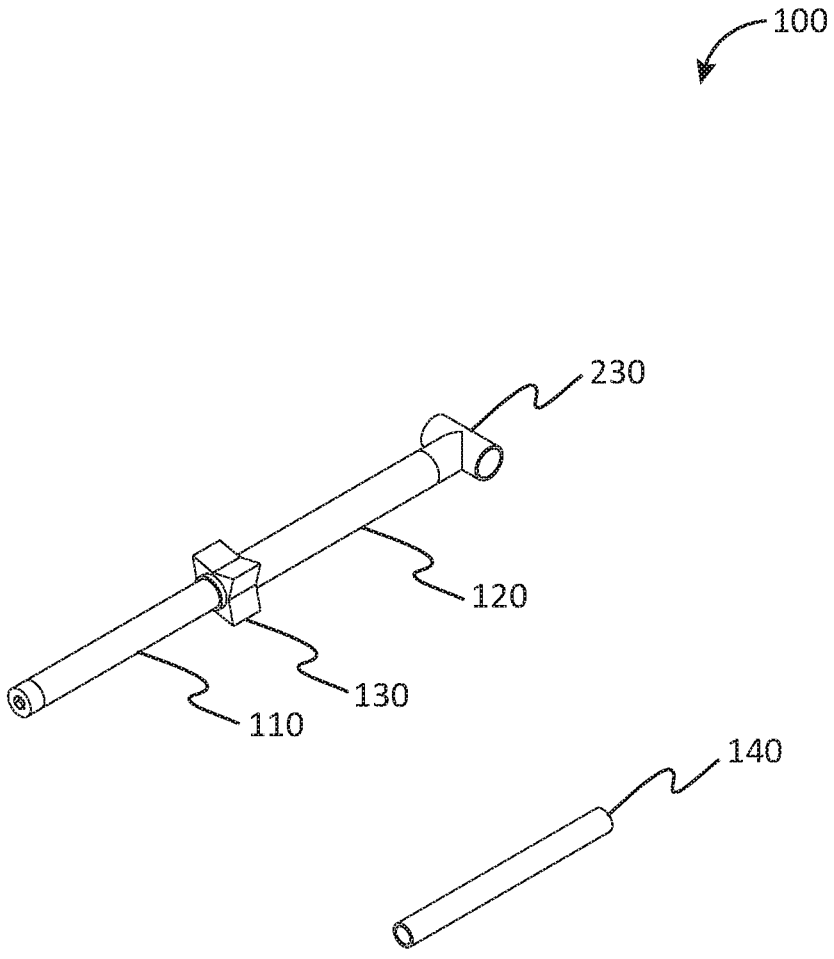
FIG. 3 is a perspective view of the exercise device of FIG. 1, according to an embodiment of the present disclosure.

FIG. 3 shows a perspective view of the exercise device 100 of FIG. 1, according to an embodiment of the present disclosure. As above, the exercise device 100 may include a first flex tube 110, a first anchor tube 120, a first resistance coupler 130, and a first stiffener rod 140. Illustrated here is a first anchor support 280. The first anchor support 280 may be attached to the first anchor tube 110 to increase traction between two substantially fixed surfaces 70. The first anchor support 280 may be removed and attached as needed. Size, shape, and dimensions of the first anchor support 280 may be determined by the application of use. As previously shown in FIG. 1, the first anchor support 280 may be useful for retaining the position of the first anchor tube 120 between two substantially fixed surfaces 70.

Figure 4:
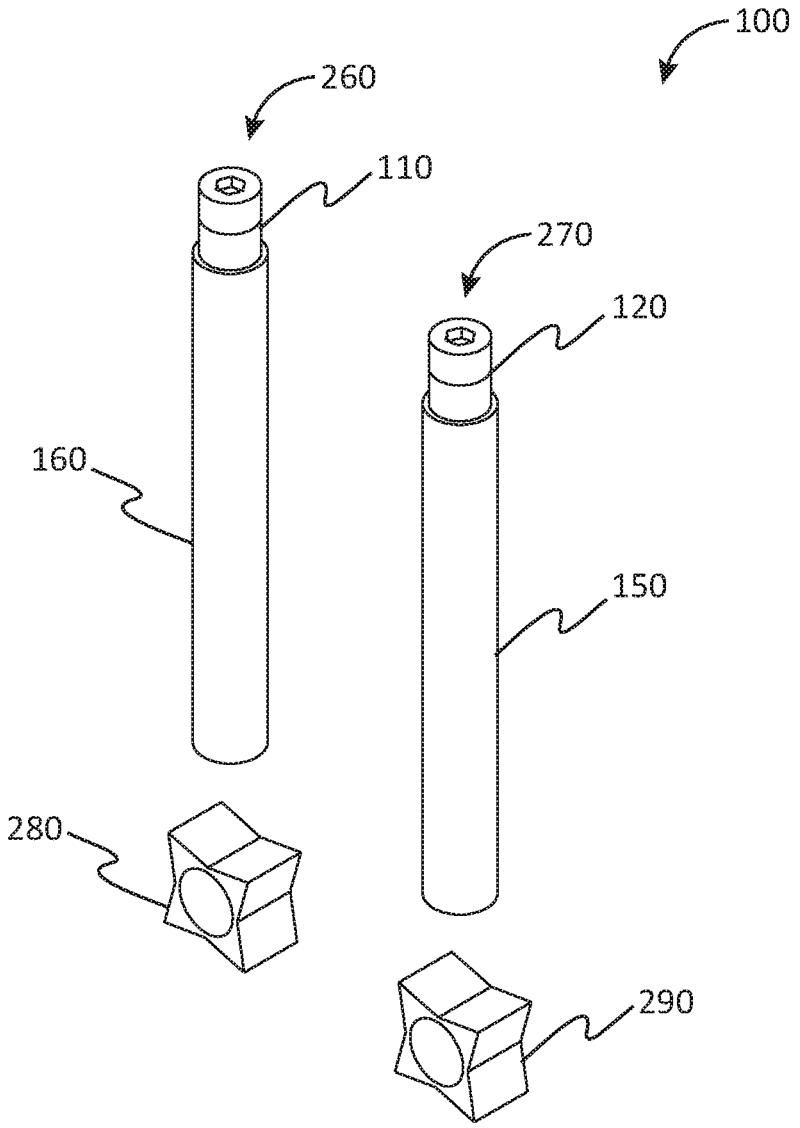
FIG. 4 is a disassembly view illustrating the exercise device, according to an embodiment of the present disclosure.

FIG. 4 shows an exploded view of the exercise device 100 of FIG. 1, according to an embodiment of the present disclosure. As above, the exercise device 100 may include a first flex tube 110, a first anchor tube 120, a first resistance coupler 130, and a first stiffener rod 140. The exercise device 100 may also include a second anchor tube 150, a second flex tube 160, a second resistance coupler 170, and a second stiffener rod 180. The first flex tube 110 is configured to nest into the second flex tube 160, thereby defining a nested flex tube set 260. Similarly, the first anchor tube 120 is configured to nest into the second anchor tube 150, thereby defining a nested anchor tube set 270. In an optimal embodiment, the bending resistance will be the same despite the differently sized diameters of the first and second set of exercise devices 100. The nested flex tube set 260 is configured to nest into the nested anchor tube set 270. This nesting may be the smallest embodiment of the exercise device 100 for portability. The exercise device 100 may further comprise a first support 280 configured to attach to the first anchor tube 110. A second support 290 may also be include and configured to attach to the second anchor tube 150. The first support 280 and the second support 290 may be used to retain the respective exercise device 100 between two substantially fixed surfaces 70, as previous shown in FIG. 1. In many of the preformed exercises the first support 280 and the second support 290 may not be used.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An exercise device comprising:

a first anchor tube configured to be anchored between two substantially fixed surfaces, said first anchor defined by two opposing first anchor ends separated by a first anchor length;

a first flex tube defined by two opposing first flex tube ends separated by a first flex tube length, said first flex tube configured to provide resistance against and in response to manual flexing of said first flex tube;

a first resistance coupler made of a resilient material, and including a first anchor couple and a first flex tube couple, said first anchor couple configured to couple with at least one of the two opposing first anchor-ends, said first flex tube couple configured to couple with at least one of the two opposing first flex tube ends, the resilient material configured to provide resistance against manual manipulation of at least one of the first anchor tube and the first flex tube a first stiffener rod sized and dimensioned to be inserted within the first flex tube length, the first stiffener rod configured to increase a bending resistance of the first flex tube;

a second anchor tube configured to be anchored between two substantially fixed surfaces, said second anchor defined by two opposing second anchor ends separated by a second anchor length;

a second flex tube defined by two opposing second flex tube ends separated by a second flex tube length, said second flex tube configured to provide resistance against and in response to manual flexing of said second flex tube;

and a second resistance coupler made of the resilient material, and including a second anchor couple and a second flex tube couple, said second anchor couple configured to couple with at least one of the two opposing second anchor ends, said second flex tube couple configured to couple with at least one of the two opposing second flex tube ends, the resilient material further configured to provide resistance against manual manipulation of at least one of the first anchor tube and the first flex tube, wherein said first flex tube is configured to nest into said second flex tube, thereby defining a nested flex tube set.

2. The exercise device of claim 1, further comprising a second stiffener rod sized and dimensioned to be inserted within the second flex tube length, the second stiffener rod configured to increase a bending resistance of the second flex tube.

3. The exercise device of claim 1, wherein said first resistance coupler and said second resistance coupler comprise rubber.

4. The exercise device of claim 1, wherein said first anchor tube is configured to nest into said second anchor tube, thereby defining a nested anchor tube set.

5. The exercise device of claim 1, further comprising:

a first support configured to attach to said first anchor tube for increasing traction between said first anchor tube and said substantially fixed surfaces; and a second support configured to attach to said second anchor tube for increasing traction between said second anchor tube and said substantially fixed surfaces.

6. The exercise device of claim 5, further comprising:

a first flex tube attachment configured to couple with one of said opposing first flex tube ends;

a second flex tube attachment configured to couple with one of said opposing second flex tube ends; and a tether coupled to each of the first flex tube attachment and the second flex tube attachment.

7. The exercise device of claim 6, further comprising:

a first anchor tube attachment configured to couple with one of said opposing first anchor tube ends; and a second anchor tube attachment configured to couple with one of said opposing second anchor tube ends.

8. The exercise device of claim 6, wherein said tether is made of a resilient material.

9. An exercise device comprising:

a first anchor tube configured to be anchored between two substantially fixed surfaces, said first anchor defined by two opposing first anchor ends separated by a first anchor length, a first flex tube defined by two opposing first flex tube ends separated by a first flex tube length, said first flex tube configured to provide resistance against and in response to manual flexing of said first flex tube, a first resistance coupler made of a resilient material, and including a first anchor couple and a first flex tube couple, said first anchor couple configured to couple with at least one of the two opposing first anchor-ends, said first flex tube couple configured to couple with at least one of the two opposing first flex tube ends, the resilient material configured to provide resistance against manual manipulation of at least one of the first anchor tube and the first flex tube a first stiffener rod sized and dimensioned to be inserted within the first flex tube length, the first stiffener rod configured to increase a bending resistance of the first flex tube, a second anchor tube configured to be anchored between two substantially fixed surfaces, said second anchor defined by two opposing second anchor ends separated by a second anchor length, a second flex tube defined by two opposing second flex tube ends separated by a second flex tube length, said second flex tube configured to provide resistance against and in response to manual flexing of said second flex tube, a second resistance coupler made of the resilient material, and including a second anchor couple and a second flex tube couple, said second anchor couple configured to couple with at least one of the two opposing second anchor ends, said second flex tube couple configured to couple with at least one of the two opposing second flex tube ends, the resilient material further configured to provide resistance against and in response to manual manipulation of at least one of the second anchor tube and the second flex tube relative to each other, a second stiffener rod sized and dimensioned to be inserted within the second flex tube length, the second stiffener rod configured to increase a bending resistance of the second flex tube, a first anchor configured to attach to said first anchor tube for increasing traction between said first support tube and said substantially fixed surfaces, a second anchor configured to attach to said second anchor tube for increasing traction between said second support tube and said substantially fixed surfaces, a first flex tube attachment configured to couple with one of said opposing first flex tube ends, a second flex tube attachment configured to couple with one of said opposing second flex tube ends, a tether coupled to each of the first flex tube attachment and the second flex tube attachment, a first anchor tube attachment configured to couple with one of said opposing first anchor tube ends, a second anchor tube attachment configured to couple with one of said opposing second anchor tube ends, wherein said first resistance coupler and said second resistance coupler comprise rubber;

wherein said first flex tube is configured to nest into said second flex tube, thereby defining a nested flex tube set;

wherein said first anchor tube is configured to nest into said second anchor tube, thereby defining a nested anchor tube set;

wherein said nested flex tube set is configured to nest into said nested anchor tube set; and, wherein said tether is made of a resilient material.

10. The exercise device of claim 9, further comprising a set of instructions; and wherein the exercise device is arranged as a kit.

* * * * *